US009379434B2

(12) United States Patent
Sato et al.

(10) Patent No.: US 9,379,434 B2
(45) Date of Patent: Jun. 28, 2016

(54) TRANSMITTING-RECEIVING-SEPARATED DUAL-POLARIZATION ANTENNA

(71) Applicants: DENKI KOGYO CO., LTD., Tokyo (JP); KDDI Corporation, Tokyo (JP)

(72) Inventors: Keisuke Sato, Tokyo (JP); Masayuki Nakano, Saitama (JP); Hiromi Matsuno, Saitama (JP)

(73) Assignees: DENKI KOGYO CO., LTD. (JP); KDDI Corporation (JP)

( * ) Notice: Subject to any disclaimer, the term of this patent is extended or adjusted under 35 U.S.C. 154(b) by 58 days.

(21) Appl. No.: 14/363,498

(22) PCT Filed: Oct. 10, 2012

(86) PCT No.: PCT/JP2012/076199

§ 371 (c)(1),
(2) Date: Jun. 6, 2014

(87) PCT Pub. No.: WO2013/084585

PCT Pub. Date: Jun. 13, 2013

(65) Prior Publication Data

US 2015/0180116 A1 Jun. 25, 2015

(30) Foreign Application Priority Data

Dec. 8, 2011 (JP) ..... 2011-268961

(51) Int. Cl.
*H01Q 1/38* (2006.01)
*H01Q 1/52* (2006.01)
(Continued)

(52) U.S. Cl.
CPC ..... *H01Q 1/525* (2013.01); *H01Q 1/526* (2013.01); *H01Q 9/0457* (2013.01);
(Continued)

(58) Field of Classification Search
CPC ..... H01Q 21/24; H01Q 1/525; H01Q 1/526; H01Q 21/065; H01Q 9/0435; H01Q 9/0457
USPC ..... 343/700 MS, 829, 841, 846
See application file for complete search history.

(56) References Cited

U.S. PATENT DOCUMENTS 4,929,959 A * 5/1990 Sorbello ..... H01Q 9/0428 343/700 MS
5,241,321 A * 8/1993 Tsao ..... H01Q 99/0435 343/700 MS (Continued)

FOREIGN PATENT DOCUMENTS

CN 1218583 A 6/1999
EP 0720252 A1 7/1996

(Continued)

OTHER PUBLICATIONS

European Search Report for Application No. EP12855682.6 dated Jul. 1, 2015.

(Continued)

*Primary Examiner* — Tho G Phan
(74) *Attorney, Agent, or Firm* — Lerner, David, Littenberg, Krumholz & Mentlik, LLP

(57) ABSTRACT

To reduce coupling between transmission and reception while implementing sharing of polarized waves for both the transmitting band and the receiving band at the same time. Patch antenna for transmitting band and patch antenna for receiving band, which are arranged at predetermined spacing, include an upper-stage ground conductor; a lower-stage ground conductor; a feed line which is arranged among the ground conductor and the lower-stage ground conductor; a feed slot which is formed on the upper-stage ground conductor; a patch which is electromagnetically coupled with the feed line via the feed slot; and electromagnetic shielding members which are connected with the upper-stage ground conductor and the lower-stage ground conductor in a state in which the electromagnetic shielding members are located around the feed line. The feed line includes independent feeding conductors corresponding to respective polarized waves.

6 Claims, 14 Drawing Sheets

(51) Int. Cl.

| | |
|---|---|
| ***H01Q 21/24*** | (2006.01) |
| ***H01Q 9/04*** | (2006.01) |
| ***H01Q 21/06*** | (2006.01) |
| *H01Q 1/24* | (2006.01) |
| *H01Q 21/08* | (2006.01) |

(52) U.S. Cl.

CPC ..... *H01Q 21/065* (2013.01); *H01Q 21/24* (2013.01); *H01Q 1/246* (2013.01); *H01Q 9/0435* (2013.01); *H01Q 21/08* (2013.01)

(56) References Cited

U.S. PATENT DOCUMENTS

| | | | | |
|---|---|---|---|---|
| 5,455,594 | A * | 10/1995 | Blasing | H01Q 1/364 343/700 MS |
| 6,008,763 | A | 12/1999 | Nystrom et al. | |
| 6,407,704 | B1 * | 6/2002 | Franey | H01Q 1/42 343/700 MS |
| 7,589,676 | B2 * | 9/2009 | Popugaev | H01Q 9/0414 343/700 MS |
| 8,427,373 | B2 * | 4/2013 | Jiang | H01Q 1/38 343/700 MS |

FOREIGN PATENT DOCUMENTS

| | | | |
|---|---|---|---|
| EP | 1962377 | A1 | 8/2008 |
| JP | 05041608 | A | 2/1993 |
| JP | 05175727 | A | 7/1993 |
| JP | 2000510305 | A | 8/2000 |
| JP | 2000278039 | A | 10/2000 |
| JP | 2005244317 | A | 9/2005 |
| JP | 2007088882 | A | 4/2007 |
| JP | 2009071795 | A | 4/2009 |
| KR | 19960027054 | | 7/1996 |
| KR | 20020017775 | A | 3/2002 |
| WO | 9743799 | A1 | 11/1997 |

OTHER PUBLICATIONS

Korean Office Action for Application No. 10-20147015044 dated May 20, 2015.

Chinese Office Action for Application No. 201280060356.3 dated May 6, 2015.

Internation Search Report for Application No. PCT/JP2012/076199 dated Dec. 4, 2012.

Keizo Cho, Ryo Yamaguchi, and Huiling Jiang, "Base Station and Terminal Antenna Technologies Required for Next Generation Mobile Communication Systems", Journal of the Institute of Electronics, Information and Communication Engineers, vol. J85-B, No. 9, pp. 886-900 (Sep. 2008) (English translation of Summary provided herwith.).

* cited by examiner

3-T,3-R

[VERTICALLY POLARIZED WAVE IN THE RECEIVING BAND]

[HORIZONTALLY POLARIZED WAVE IN THE RECEIVING BAND]

〔VERTICALLY POLARIZED WAVE IN THE TRANSMITTING BAND〕

〔HORIZONTALLY POLARIZED WAVE IN THE TRANSMITTING BAND〕

[RECEIVING BAND($d=0.4\lambda_0$)]

[TRANSMITTING BAND ($d=0.4\lambda_0$)]

[RECEIVING BAND ($d=0.5\lambda_0$)]

〔TRANSMITTING BAND(d=0.5$\lambda_0$)〕

TRANSMITTING-RECEIVING-SEPARATED DUAL-POLARIZATION ANTENNA

CROSS REFERENCE TO RELATED APPLICATIONS

The present application is a national phase entry under 35 U.S.C. §371 of International Application No. PCT/JP2012/076199, filed Oct. 10, 2012, published in Japanese, which claims priority from Japanese Patent Application No. 2011-268961 filed Dec. 8, 2011, all of which are hereby incorporated herein by reference.

TECHNICAL FIELD

The present invention relates to a transmitting-receiving-separated dual-polarization antenna particularly preferable for use at a mobile communication base station.

BACKGROUND ART

In order to secure power per bit, which has been increasing as the data transmission speed becomes higher, it is useful to reduce the loss in a feed system (see Non-Patent Literature 1, for example). FIG. 20 illustrates a configuration in which a transmitting and receiving front end circuit and an antenna are integrally implemented, which is one of the means for implementing the reduction of loss in a feed system.

In FIG. 20, a diplexer 103, which separates transmitting and receiving bands, is provided immediately below an antenna 101, and bandpass filters 105 and 107 for removing unnecessary frequency band signals are provided in a stage subsequent to the diplexer 103. A low noise amplifier (LNA) 109, which is arranged in a stage subsequent to the bandpass filter 105, and a power amplifier (PA) 111, which is arranged in a stage subsequent to the bandpass filter 107, are provided in order to increase the level of signals in the receiving band and the transmitting band, respectively.

According to the above-described configuration, the reduction of a noise figure (NF) can be implemented for the receiving band, and the reduction of required radiation power can be implemented for the transmitting band. However, if the above-described configuration is applied to a frequency division duplex (FDD) system, a required value becomes high for the bandstop amount for signals in unnecessary frequency bands in order to separate signals in the transmitting band, and accordingly, a problem may arise such that it becomes necessary to respond to the high required value by using a multi-stage large diplexers and bandpass filters.

Under these circumstances, in order to implement a small-sized filter, the transmitting-receiving-separated antennas according to Patent Literatures 1 to 3 have been proposed, which additionally include function of a diplexer. The transmitting-receiving-separated antennas implement reduction of the number of stages of filters arranged at stages subsequent to the antenna by suppressing cross coupling between an antenna for the transmitting band and an antenna for the receiving band (this phenomenon will be hereafter referred to as "coupling between transmission and reception"). The antenna according to Patent Literature 1 reduces coupling between transmission and reception in a configuration in which polarized waves in the transmitting and those in the receiving band are crossed one another, and coupling between transmission and reception as low as about −35 dB can be achieved thereby. The antenna according to Patent Literature 2 reduces coupling between transmission and reception in the transmitting band, even among the same polarized waves, to a level as low as about −30 dB by providing a parasitic element intended as a bandstop. The antenna according to Patent Literature 3 reduces coupling between transmission and reception to a level as low as about −50 dB by using circular polarization antennas of the same nutation direction as antennas for the transmitting band and the receiving band and by allowing one element structure to rotate.

The above-described antennas according to Patent Literatures 1 and 2 have a basic structure as a transmitting-receiving-separated patch antenna which uses a microstrip line. Now, coupling between transmission and reception occurring in the case in which polarized waves are shared in a transmitting-receiving-separated patch antenna described above will be discussed. FIG. 21 is a perspective view which illustrates a transmitting-receiving-separated dual-polarization patch antenna which uses a microstrip line as a feed line, and FIG. 22 is an exploded view of the patch antenna. The transmitting-receiving-separated dual-polarization patch antenna includes a patch antenna 201-T for a transmitting band and a patch antenna 201-R for a receiving band. The patch antenna 201-T for transmitting band is constituted by a patch 203, a cross-shaped feed slot 205, which is located below the patch 203, and feed lines 207*a* and 207*b*, which are located below the feed slot 205. The patch antenna 201-R has a similar configuration. The feed slot 205 of the patch antenna 201-T, 201-R is formed on a common ground conductor plate 209. In addition, a dielectric substrate 211 is arranged between the ground conductor plate 209 and the feed line 207*a*, 207*b*. Note that the transmitting-receiving-separated dual-polarization patch antenna does not include any configuration for implementing the bandstop, which is included in the antenna according to Patent Literature 2.

In the transmitting-receiving-separated dual-polarization patch antenna, power is fed to the patch 203 of the patch antenna 201-T for the transmitting band so that polarized waves are shared by electromagnetic coupling with the feed line 207*a*, 207*b* via the corresponding feed slot 205. The patch 203 of the patch antenna 201-R for the receiving band has a similar configuration. FIG. 23 illustrates a characteristic of coupling between transmission and reception with respect to the transmitting-receiving-separated dual-polarization patch antenna. In this drawing, $f_R$ denotes a center frequency of the receiving band, $f_T$ denotes a center frequency of the transmitting band, and $f_0$ denotes a center frequency between a lower limit frequency of the receiving band and an upper limit frequency of the transmitting band, respectively, and $f_R=0.953\ f_0$, $f_T=1.047\ f_0$.

As is clear from the coupling characteristic, according to the transmitting-receiving-separated dual-polarization patch antenna, coupling between transmission and reception among cross polarized waves (i.e., among vertically polarized waves for the receiving band and horizontally polarized waves for the transmitting band, and among horizontally polarized waves for the receiving band and vertically polarized waves for the transmitting band) can be reduced to −40 dB or lower, however, with respect to the coupling between transmission and reception among the same polarized waves (i.e., among vertically polarized waves for the receiving band and vertically polarized waves for the transmitting band, and among horizontally polarized waves for the receiving band and horizontally polarized waves for the transmitting band), the worst case value becomes −20 dB or higher. As described above, in the transmitting-receiving-separated dual-polarization patch antenna described above, coupling among the same polarized waves becomes intense.

CITATION LIST

Patent Literature

[Patent Literature 1] Japanese Patent Application Laid-Open No. 05-41608

[Patent Literature 2] Japanese Patent Application Laid-Open No. 2009-71795

[Patent Literature 3] Japanese Patent Application Laid-Open No. 05-175727

[Non-Patent Literature 1] Keizo CHO, Ryo YAMAGUCHI, and Huiling JIANG, "Base Station and Terminal Antenna Technologies Required for Next Generation Mobile Communication Systems", Journal of the Institute of Electronics, Information and Communication Engineers, Vol. J85-B, No. 9, pp. 886-900 (September 2008)

SUMMARY OF INVENTION

Technical Problem

In future mobile communications typified by Long Term Evolution (LTE), Multi-Input Multi-Output (MIMO) becomes the main technology, and in order to apply the above-described transmitting-receiving-separated patch antennas to MIMO, it becomes necessary to reduce coupling between transmission and reception while implementing sharing of polarized waves at the same time for both the transmitting band and the receiving band. However, as described above, if polarized waves are shared in the conventional transmitting-receiving-separated patch antenna, a problem may arise such that coupling between transmission and reception among same polarized waves may not be reduced.

In order to solve the above-described problems, the purpose of the present invention is to provide a transmitting-receiving-separated dual-polarization antenna capable of reducing coupling between transmission and reception while implementing sharing of polarized waves for both the transmitting band and the receiving band at the same time.

Solution to Problem

According to an aspect of the present invention, a transmitting-receiving-separated dual-polarization antenna includes a patch antenna for a transmitting band and a patch antenna for a receiving band. The patch antenna for the transmitting band and the patch antenna for the receiving band have a predetermined spacing therebetween. Each of the patch antenna for the transmitting band and the patch antenna for the receiving band comprises an upper-stage ground conductor, a lower-stage ground conductor, a feed line arranged between the ground conductors, a feed slot formed on the upper-stage ground conductor, a patch electromagnetically coupled with the feed line via the feed slot, and an electromagnetic shielding member connected with the upper-stage ground conductor and the lower-stage ground conductor in a state in which the electromagnetic shielding member is located around the feed line, and the feed line includes independent feeding conductors corresponding to respective polarized waves.

The electromagnetic shielding member is formed by multiple through holes, which are arranged around the feed line at predetermined spacing and extended from the upper-stage ground conductor to the lower-stage ground conductor, for example. In addition, the electromagnetic shielding member may be formed by a metal plate, which is arranged around the feed line and extended from the upper-stage ground conductor to the lower-stage ground conductor.

It is preferable if the spacing for arranging the patch antenna for the transmitting band and the patch antenna for the receiving band be set at $0.5\lambda_0$ ($\lambda_0$ is a wavelength of a center frequency between a lower limit frequency for the receiving band and an upper limit frequency for the transmitting band) or smaller. In addition, the feed slot may be square-shaped or cross-shaped. Further, a transmitting-receiving-separated dual-polarization antenna having an array configuration may be implemented by arranging multiple stages of the transmitting-receiving-separated dual-polarization antennas.

Advantageous Effects of Invention

According to the present invention, coupling between transmission and reception can be reduced while implementing sharing of polarized waves for both the transmitting band and the receiving band. For example, even in a case in which the element spacing among the patch antennas for the transmitting band and the patch antennas for the receiving band is set as narrow as $0.4\lambda_0$ ($\lambda_0$ is a wavelength of the center frequency between a lower limit frequency for the receiving band and an upper limit frequency for the transmitting band), coupling between transmission and reception as low as −30 dB or lower can be implemented. In addition, according to the present invention, it is enabled to downsize a bandpass filter provided at a subsequent stage by omitting a diplexer which may otherwise be arranged inside a transmitting and receiving front end circuit.

BRIEF DESCRIPTION OF DRAWINGS

FIG. 14(*b*) is a view which illustrates the distribution of field intensity observed when no through holes are provided.

DESCRIPTION OF EMBODIMENTS

In the following description, $f_0$ and $\lambda_0$ are a center frequency between a lower limit frequency of the receiving band and an upper limit frequency of the transmitting band and a wavelength thereof, respectively, $f_R$ and $\lambda_R$ are a center frequency of the receiving band and a wavelength thereof, respectively, $f_T$ and $\lambda_T$ are a center frequency of the transmitting band and a wavelength thereof, respectively, and $f_R$=0.953 $f_0$ (wavelength $\lambda_R$=1.049$\lambda_0$), $f_T$=1.047 $f_0$ (wavelength $\lambda_T$=0.955$\lambda_0$).

Figure 1:
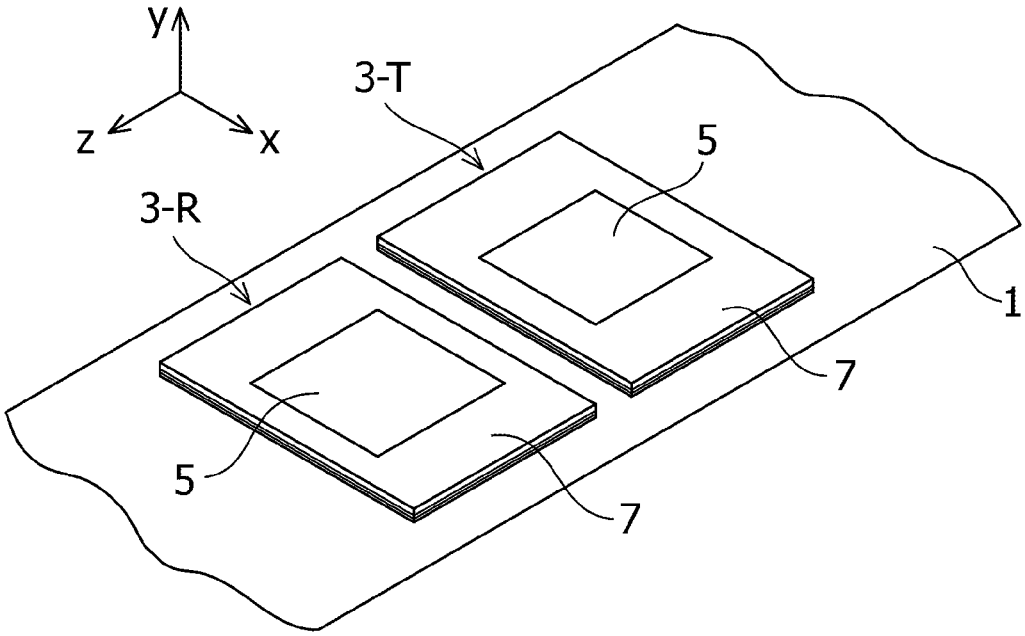
FIG. 1 is a perspective view which illustrates an embodiment of a transmitting-receiving-separated dual-polarization patch antenna according to the present invention.
Figure 2:
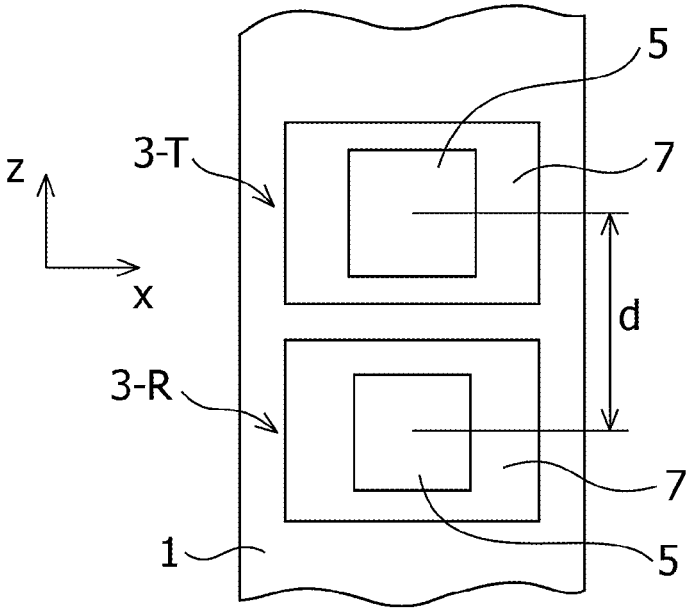
FIG. 2 is a plan view which illustrates an antenna according to an embodiment.

FIGS. 1 and 2 are a perspective view and a plan view which illustrate an embodiment of a transmitting-receiving-separated dual-polarization patch antenna according to the present invention. In these drawings, the direction of z-axis is perpendicular to the ground and the xy plane is a plane parallel to the ground. A transmitting-receiving-separated antenna according to the present embodiment includes a patch antenna 3-T for a transmitting band and a patch antenna 3-R for a receiving band, which are installed on a conductor substrate 1. The patch antenna 3-R for the receiving band and the patch antenna 3-T for the transmitting band are arranged at spacing d between them of 0.5$\lambda_0$ or smaller, and the spacing d is set at 0.4$\lambda_0$ in the present embodiment.

Figure 3:
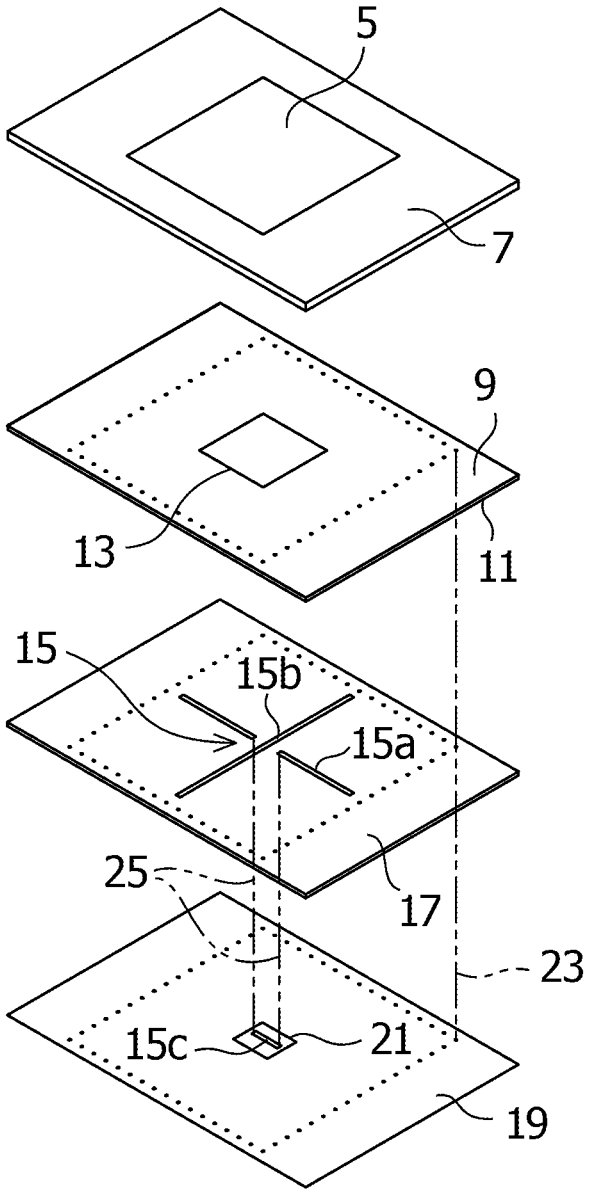
FIG. 3 is an exploded perspective view which illustrates a patch antenna for a transmitting band and a patch antenna for a receiving band.
Figure 4A:
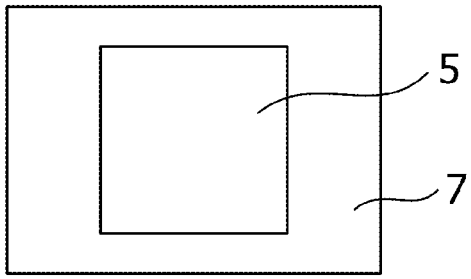
FIGS. 4(*a*) through 4(*d*) are plan views which illustrate a planar structure of a patch, an upper-stage ground conductor, a feed line, and a lower-stage ground conductor, respectively.
Figure 4B:
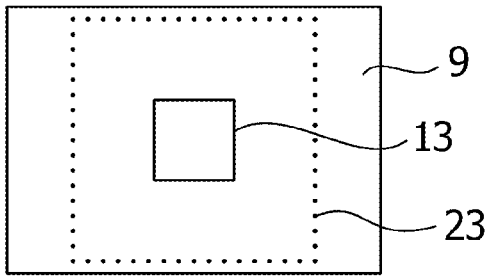
Figure 4C:
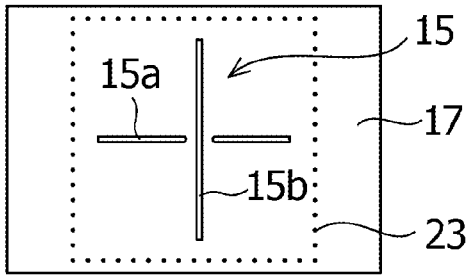
Figure 4D:
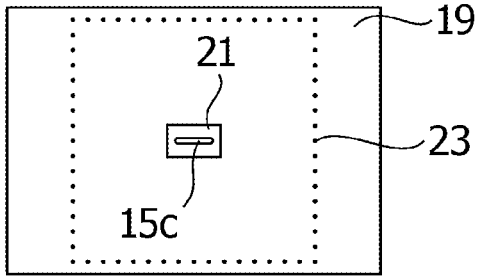

The patch antenna 3-T for the transmitting band and the patch antenna 3-R for the receiving band include at least four layers constituted by metal plates as illustrated in the exploded perspective view in FIG. 3. The first layer (the top layer) is a patch 5 having a square shape, which is an excitation element (an antenna element). The patch 5 is formed in the center of an upper surface of a dielectric substrate 7. The second layer is an upper-stage ground conductor 9. The upper-stage ground conductor 9 is adhered to an upper surface of a dielectric substrate 11, and a feed slot 13 is formed in the center thereof. The third layer is a feed line 15. The feed line 15 includes a feeding conductor 15*a* for horizontally polarized wave and a feeding conductor 15*b* for vertically polarized wave, which are formed on an upper surface of a dielectric substrate 17, and a bridge conductor 15*c*, which will be described below. The fourth layer (the bottom layer) is a lower-stage ground conductor 19.

The lower-stage ground conductor 19 is adhered to a lower surface of the dielectric substrate 17, and a slot 21 is formed in the center thereof. Further, the above-described bridge conductor 15*c* is formed in an inside of the slot 21. Note that the upper-stage ground conductor 9, the dielectric substrate 11, the feed line 15, the dielectric substrate 17, and the lower-stage ground conductor 19 constitute a feed line known as a triplate feed line. Note that in the present embodiment, dielectric substrates of which relative dielectric constant $\in_r$ is about 3.3 are used for the dielectric substrates 7, 11, and 17.

The patch 5, the upper-stage ground conductor 9, the feed line 15, and the lower-stage ground conductor 19 described above are constituted by a metal foil such as a copper foil, respectively, and are patterned by using a method for forming a printed wiring pattern (a method in which a predetermined metal foil pattern is formed on a surface of a dielectric by etching processing and the like). When the dielectric substrates 7, 11, and 17 are mutually stacked, the center points of the patch 5, the upper-stage ground conductor 9, the feed line 15, and the lower-stage ground conductor 19 are located on a common axis.

Figure 5:
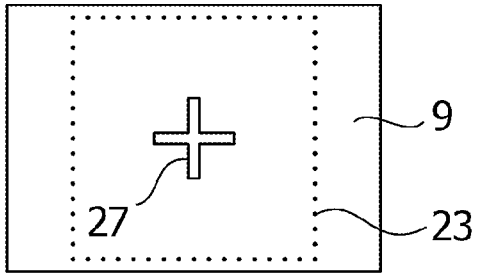
FIG. 5 is a plan view which illustrates another example of a feed slot.

FIGS. 4(*a*) through 4(*d*) illustrate a planar structure of the patch 5, the upper-stage ground conductor 9, the planar structure of the feed line 15, and the lower-stage ground conductor 19, respectively. Now, values of structure parameter for generating resonance in the receiving band will be described. The patch 5 is formed so as to form a square about 0.25$\lambda_R$ on a side, and the feed slot 13, which is provided on the upper-stage ground conductor 9, is formed so as to form a square about 0.1$\lambda_R$ on a side, for example. The structures of the patch 5 and the feed slot 13 are determined according to the resonance frequency band, and each side of the patch 7 is set at 0.228$\lambda_R$ and each side of the feed slot 13 is set at 0.125$\lambda_R$, respectively. The feed slot 13 according to the present embodiment is formed so as to be square-shaped, however, the configuration of the feed slot 13 is not limited to this, and similar functions can be achieved if a cross-shaped feed slot 27, which is illustrated in FIG. 5, is used.

Figure 6:
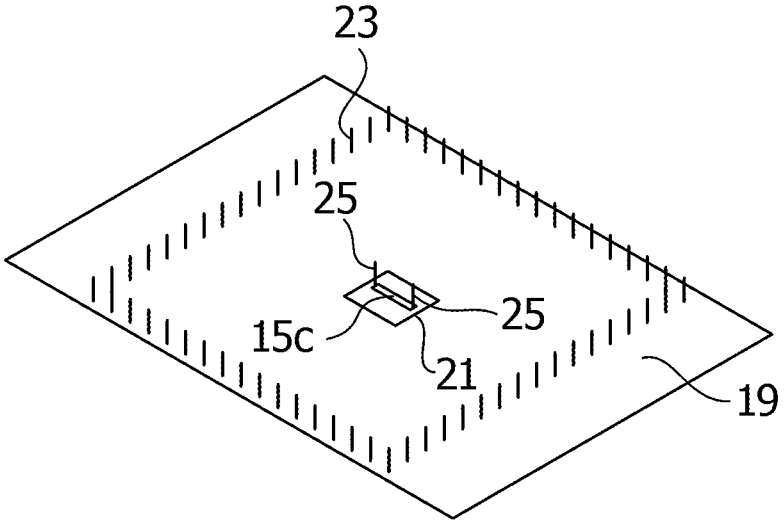
FIG. 6 is a perspective view which illustrates a mode of arrangement of through holes.

As illustrated in FIG. 3, the upper-stage ground conductor 9 and the lower-stage ground conductor 19 are electrically short-circuited via through holes 23, which penetrate through the dielectric substrates 11 and 17. Accordingly, both ground conductors 9 and 19 have the same potential. As illustrated in FIGS. 4 through 6, the through holes 23 are arranged at spacing of 0.01 to 0.02$\lambda_R$ on each side of the square-shaped area about 0.25 to 0.35$\lambda_R$ on a side. Note that the center point of the square-shaped area and that of the patch 5 have the same value of xz coordinates (see FIG. 2).

Figure 7:
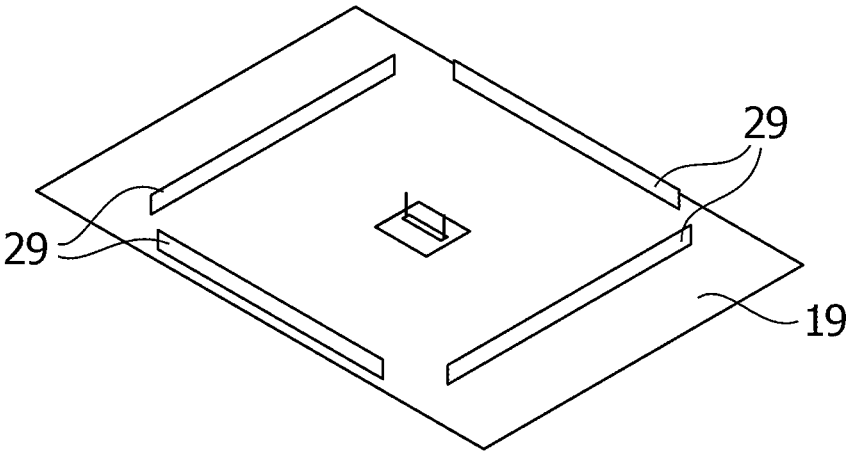
FIG. 7 is a perspective view which illustrates metal plates used instead of the through holes.

Metal plates 29 illustrated in FIG. 7 can be used instead of the above-described through holes 23. The metal plates 29 have a height substantially the same as that of the through holes 23, and are provided along respective sides of the above-described square-shaped area. In short-circuiting the upper-stage ground conductor 9 and the lower-stage ground conductor 19 by using the metal plates 29, slits through which the metal plate 29 is allowed to penetrate are formed in the upper-stage ground conductor 9, the dielectric substrate 11, the dielectric substrate 17, and the lower-stage ground conductor 19, respectively, and upper edges and lower edges of the metal plates 29 penetrated through the slits are connected with an upper surface of the upper-stage ground conductor 9 and a lower surface of the lower-stage ground conductor 19, respectively, by using means such as soldering. The values of the structure parameter for generating resonance in the receiving band are as described above. The values of the structure parameter set in generating resonance in the transmission band are values obtained by substituting the wavelength $\lambda_R$ with the wavelength $\lambda_T$. The patch antenna 3-R for the receiving band and the patch antenna 3-T for the transmitting band illustrated in FIG. 1 and the patch antenna 3-T for the transmitting band operate only for the frequency band used by the respective antennas by setting the structure parameter values in the above-described manner.

Incidentally, in order to share polarized waves, it is necessary to separate between the feeding conductor 15*a* for horizontally polarized wave and the feeding conductor 15*b* for vertically polarized wave. This is the reason why the center of the conductor element 15*b* is cut out. Each end of the conductor element 15*b* which faces the notch part is connected with the above-described bridge conductor 15*c* via through holes 25 which penetrate through the dielectric substrate 17. As described above, the bridge conductor 15*c* and the through holes 25 are bridge-connected while bypassing the contact between the conductor element 15*b* and the conductor element 15*a*, which are divided by the notch into two portions. Note that the bridge conductor 15*c* may be provided inside the feed slot 13 of the upper-stage ground conductor 9.

It is preferable that the antenna according to the present invention be manufactured by using a multilayer substrate as described above in consideration of its configuration. In the patch antenna 3-R for the receiving band, one end of the feeding conductor 15*a* and one end of the feeding conductor 15*b* are the feeding points for horizontally polarized waves and vertically polarized waves, respectively. This also applies to the patch antenna 3-T for the transmitting band. Further, the patch antenna 3-T for the transmitting band and the patch antenna 3-R for the receiving band perform a transmitting operation and a receiving operation, respectively, by sharing polarized waves due to electromagnetic coupling between the patch 5 and the feed line 15 via the corresponding feed slot 13.

Figure 8:
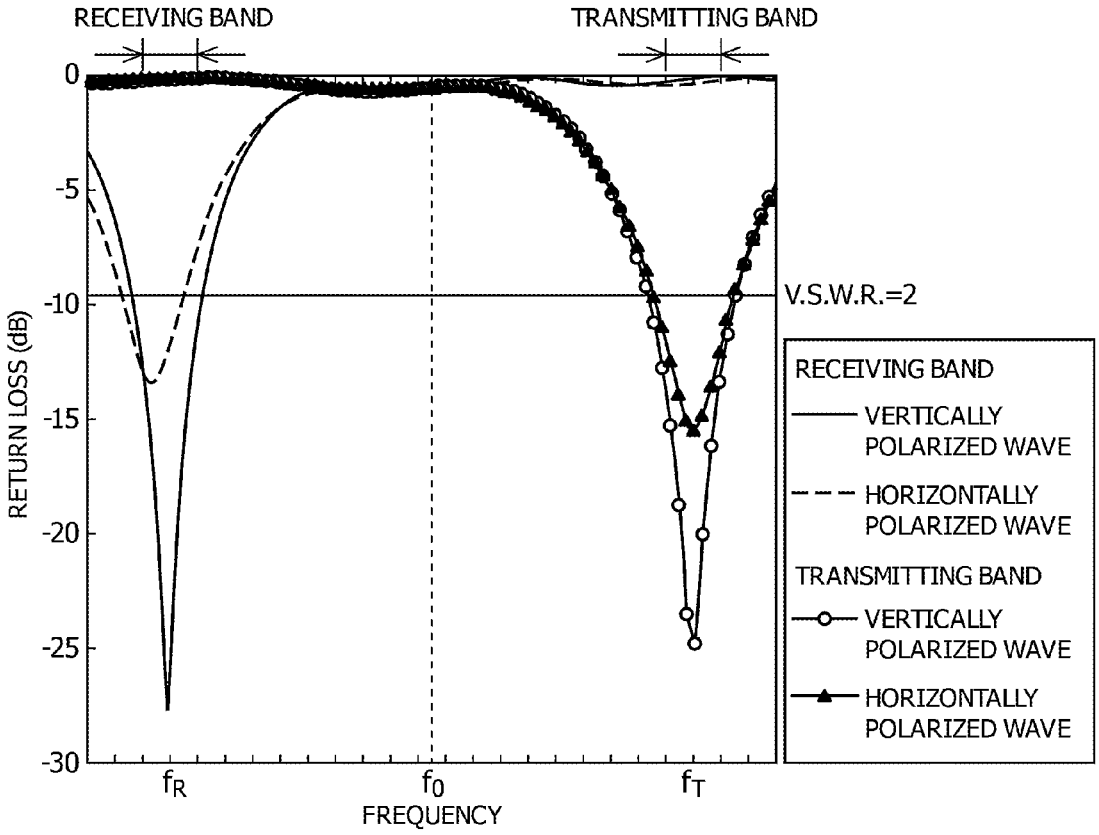
FIG. 8 is a graph which illustrates return loss characteristics of the antenna according to an embodiment.

FIG. 8 illustrates results of simulation of return loss occurring in the antenna according to the present embodiment. As is clear from the return loss characteristic, according to the antenna of the present embodiment, the fractional bandwidth, in which the return loss is −9.6 dB or lower, is about 1.1% with respect to horizontally polarized waves in the receiving band of which the fractional bandwidth is the narrowest.

Figure 9:
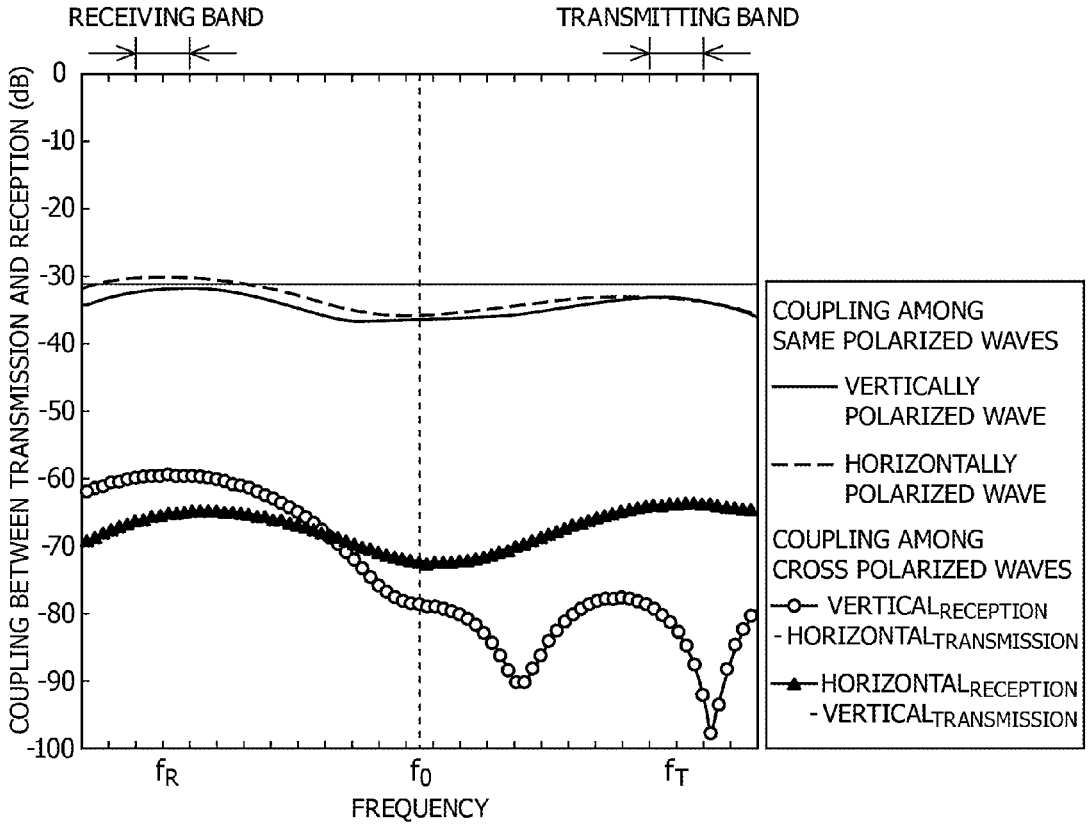
FIG. 9 is a graph which illustrates transmission-reception coupling characteristics of the antenna according to an embodiment.

FIG. 9 illustrates characteristics of coupling between transmission and reception of the antenna according to the present embodiment. As is clear from the characteristics of coupling between transmission and reception, the coupling value becomes high in the case where the waves are polarized in the same direction in both the transmitting band and the receiving band, however, as is clear from the fact that the worst case value is −30 dB, which is a value in the receiving band in which the waves are horizontally polarized waves, the antenna according to the present embodiment has excellent characteristics as a whole. The coupling between transmission and reception among cross polarized waves has excellent values of −60 dB or lower for both the transmitting band and the receiving band. As described above, according to the antenna of the present embodiment, the coupling between transmission and reception can be reduced to −30 dB or lower while implementing sharing of polarized waves in both the transmitting band and the receiving band. This is because the through holes 23 illustrated in FIG. 6 or the metal plates 29 illustrated in FIG. 7 have a function as an electromagnetic shielding member which suppresses coupling between transmission and reception.

Figure 10:
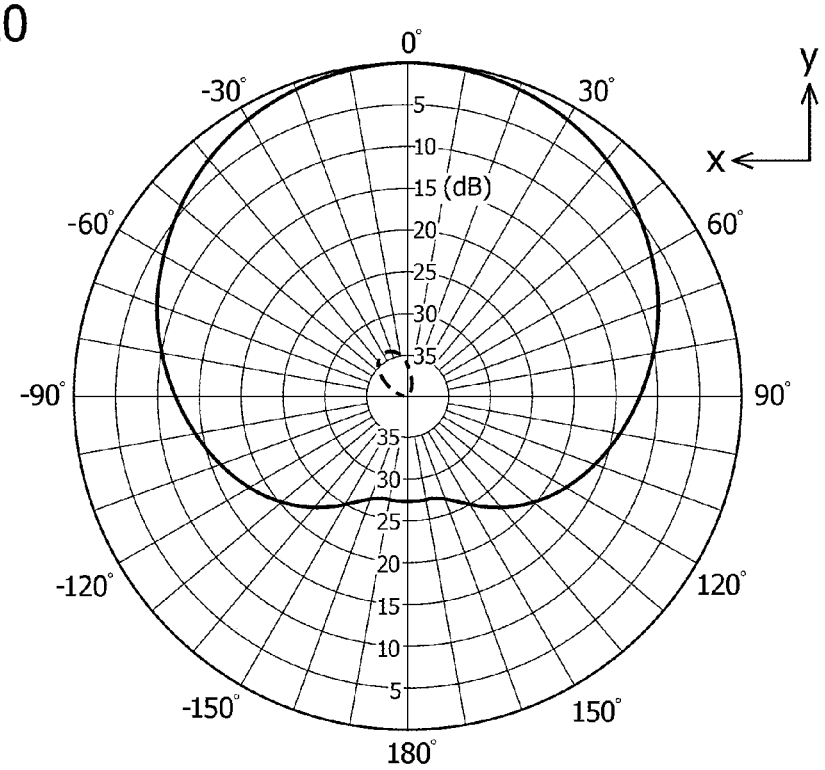
FIG. 10 is a graph which illustrates a radiation pattern of vertically polarized waves in the receiving band on the xy plane of the antenna according to an embodiment.
Figure 11:
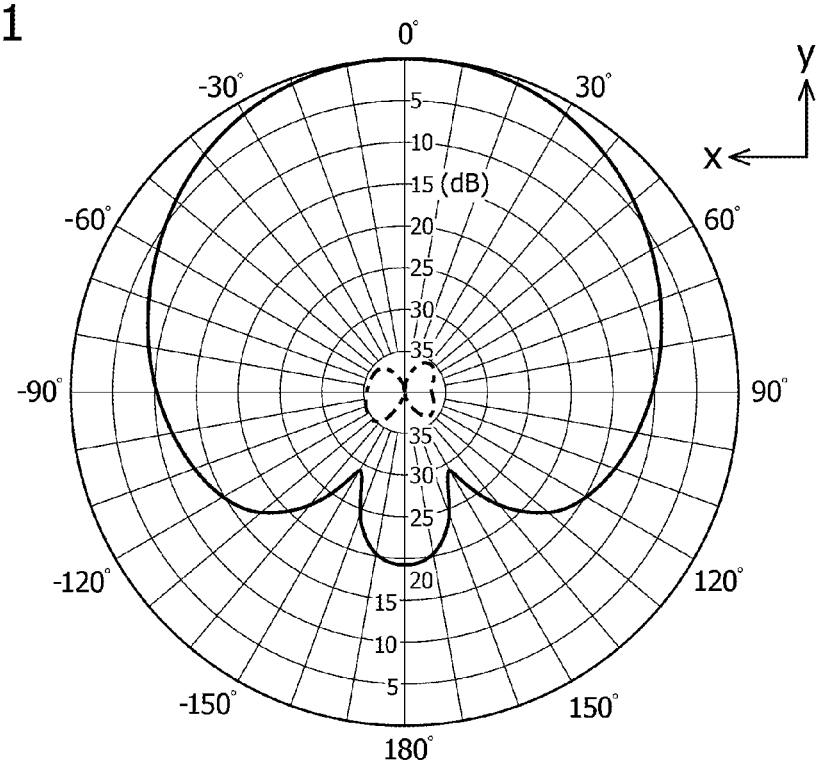
FIG. 11 is a graph which illustrates a radiation pattern of horizontally polarized waves in the receiving band on the xy plane of the antenna according to an embodiment.
Figure 12:
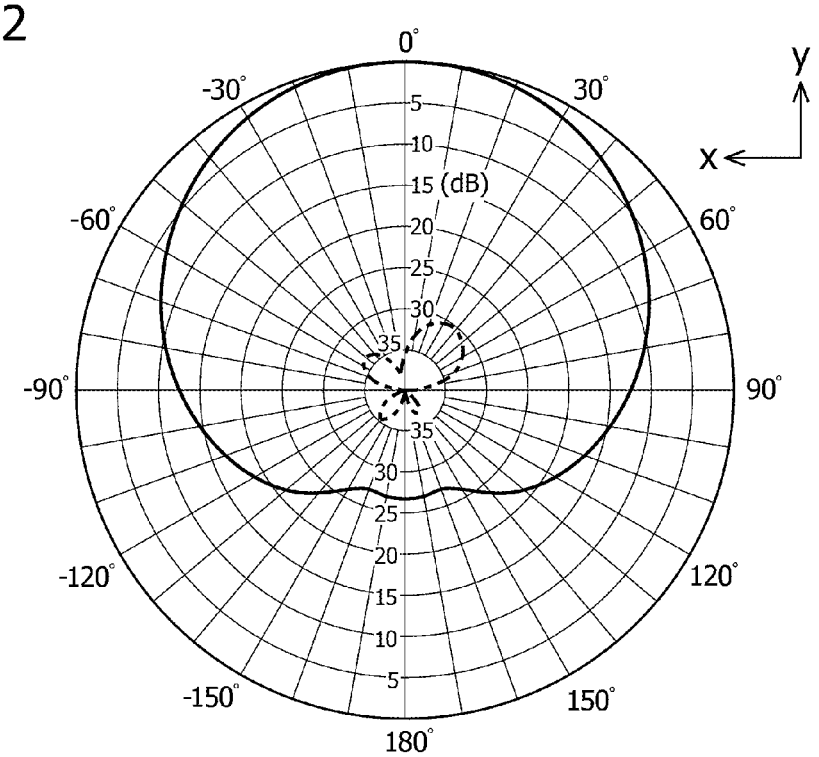
FIG. 12 is a graph which illustrates a radiation pattern of the vertically polarized waves in the transmitting band on the xy plane of the antenna according to an embodiment.
Figure 13:
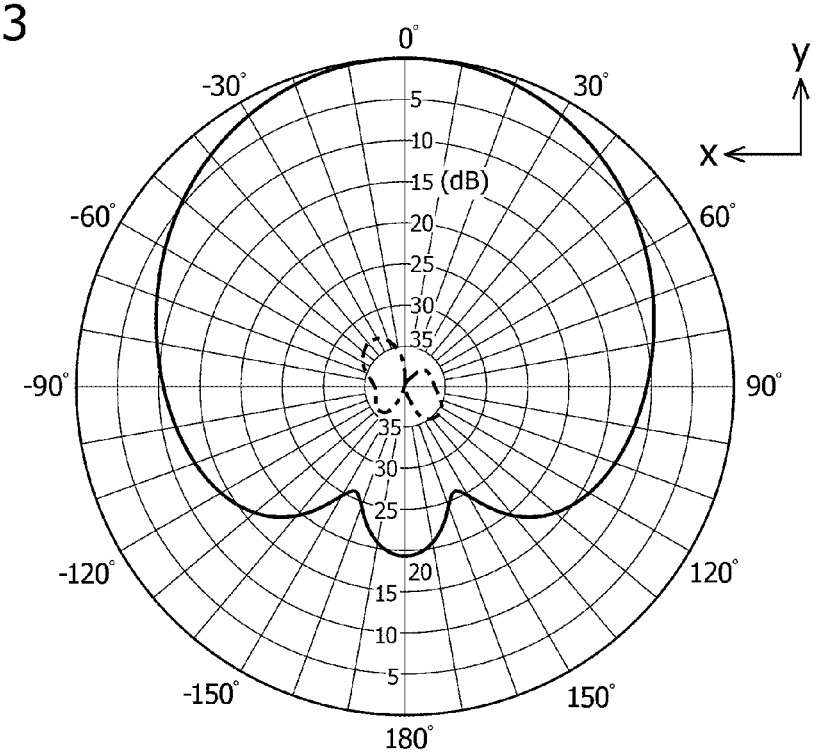
FIG. 13 is a graph which illustrates a radiation pattern of horizontally polarized waves in the transmitting band on the xy plane of the antenna according to an embodiment.

FIG. 10 illustrates a radiation pattern of vertically polarized waves in the receiving band on the xy plane of the antenna according to the present embodiment, FIG. 11 illustrates a radiation pattern of horizontally polarized waves in the receiving band on the xy plane of the antenna, FIG. 12 illustrates a radiation pattern of the vertically polarized waves in the transmitting band on the xy plane of the antenna, and FIG. 13 illustrates a radiation pattern of horizontally polarized waves in the transmitting band on the xy plane of the antenna, respectively. As is clear from these drawings, according to the antenna of the present embodiment, an excellent radiation pattern with a half bandwidth of about 80° can be achieved both in the transmitting band and the receiving band and regardless of the type of polarization.

Figure 14B:
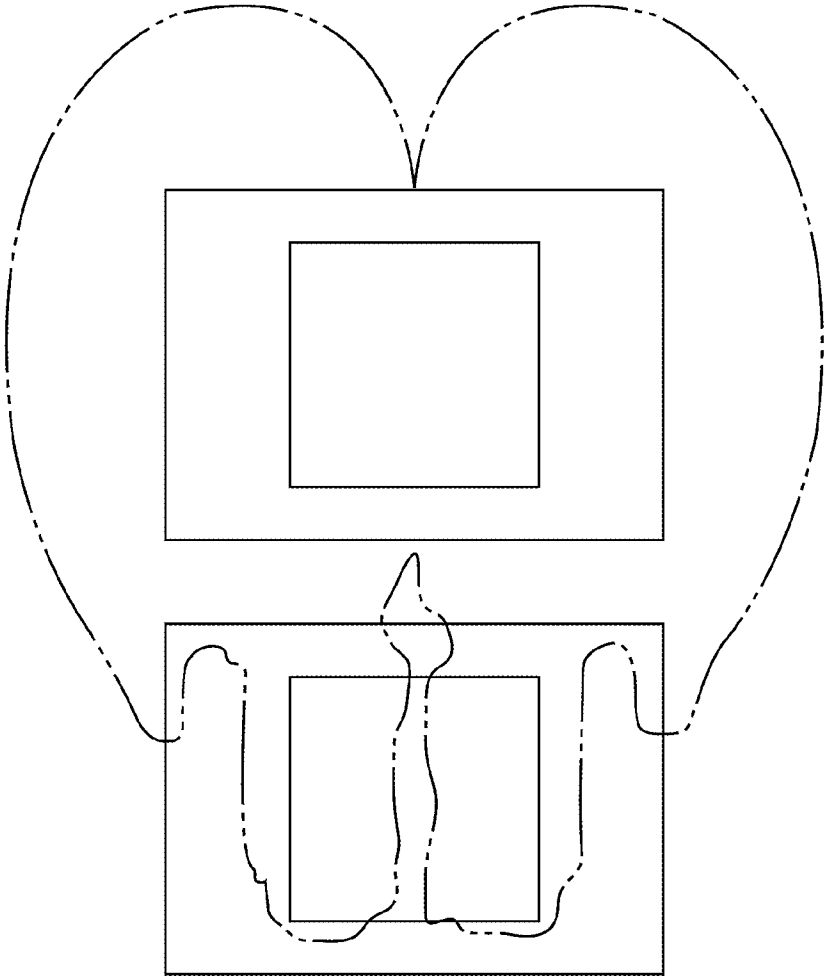
FIG. 14(*a*) is a view which illustrates the distribution of field intensity of the antenna according to an embodiment.
Figure 14A:
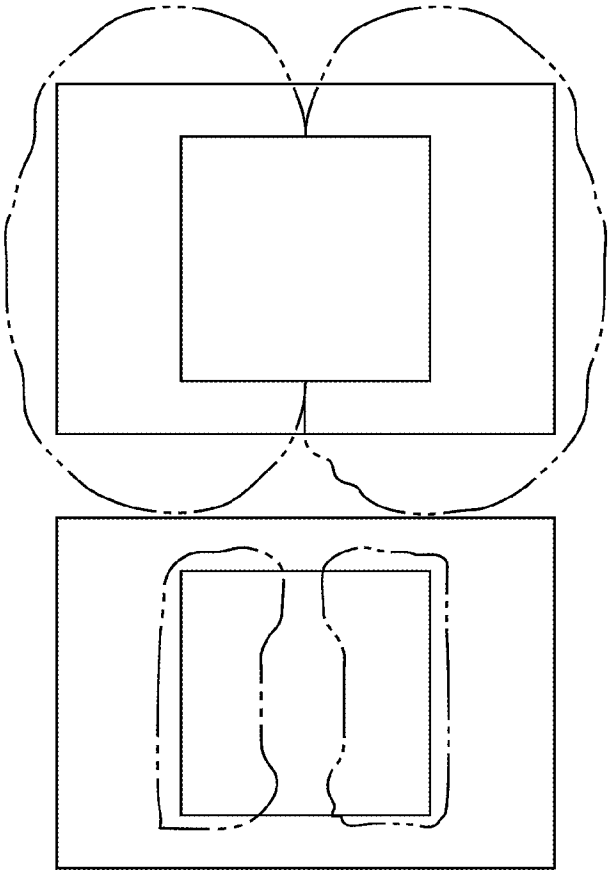

FIG. 14(*a*) illustrates the distribution of field intensity with respect to the antenna according to the present embodiment, which is observed when horizontally polarized waves in the receiving band are excited. FIG. 14(*b*) illustrates the distribution of field intensity with respect to the antenna of Comparative Example, in which no through holes 23 are provided. According to the antenna of the present embodiment having the through holes 23, the amount of electric field creeping from the excited patch 5 to a non-excited patch 5 can be effectively reduced due to the electromagnetic shield action of the through holes 23. To paraphrase this, the amount of coupling between the patch antenna 3-R for the receiving band and the patch antenna 3-T for the transmitting band is reduced.

Figure 15:
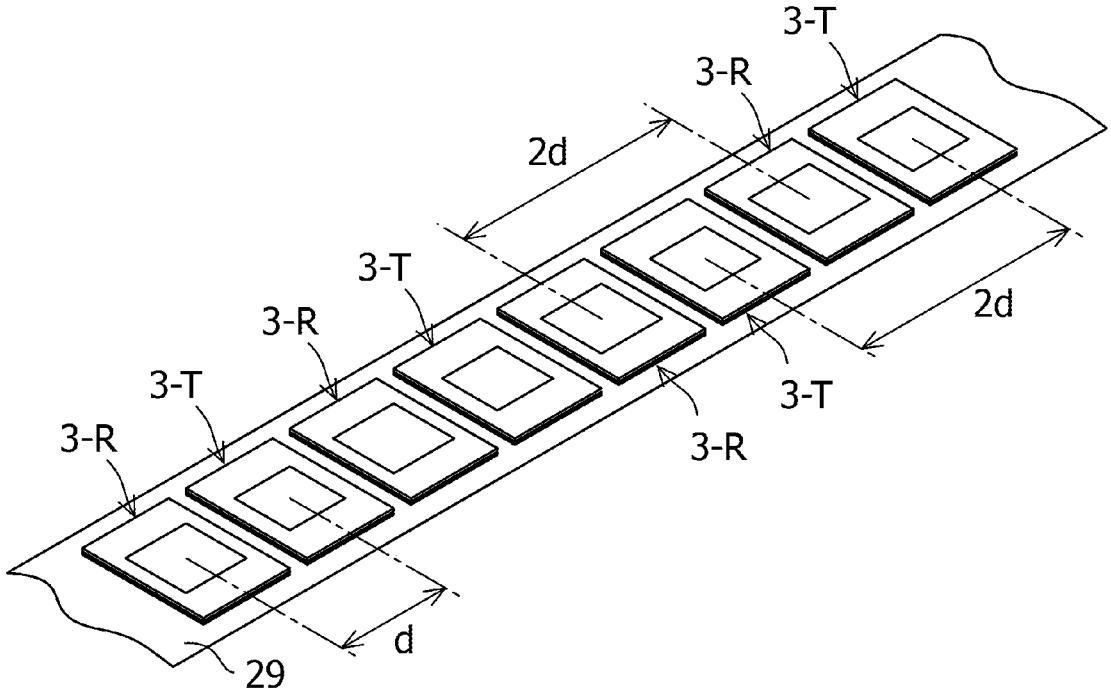
FIG. 15 is a perspective view which illustrates a transmitting-receiving-separated dual-polarization patch antenna having an allayed array configuration.

FIG. 15 illustrates a transmitting-receiving-separated dual-polarization antenna having an array configuration, in which multiple stages of the transmitting-receiving-separated dual-polarization patch antenna illustrated in FIG. 1 are arranged on the metal plate 29. In the antenna, the patch antenna 3-T for the transmitting band and the patch antenna 3-R for the receiving band are alternately arranged. Further, the spacing between mutually adjacent patch antennas 3-T for the transmitting band and the spacing between mutually adjacent patch antennas 3-R for the receiving band are set at a value 2*d*, which is twice as large as the element spacing (the spacing between the patches 5) d illustrated in FIG. 2.

Figure 16:
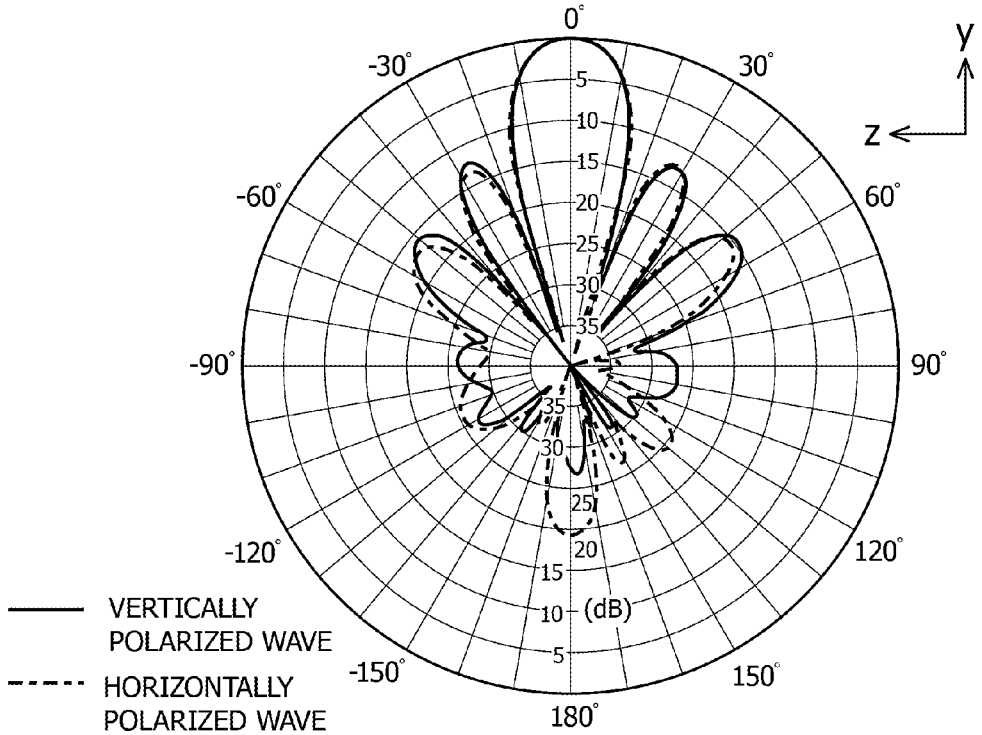
FIG. 16 is a graph which illustrates a radiation pattern of waves in the receiving band on the yz plane of the transmitting-receiving-separated dual-polarization patch antenna having an array configuration.
Figure 17:
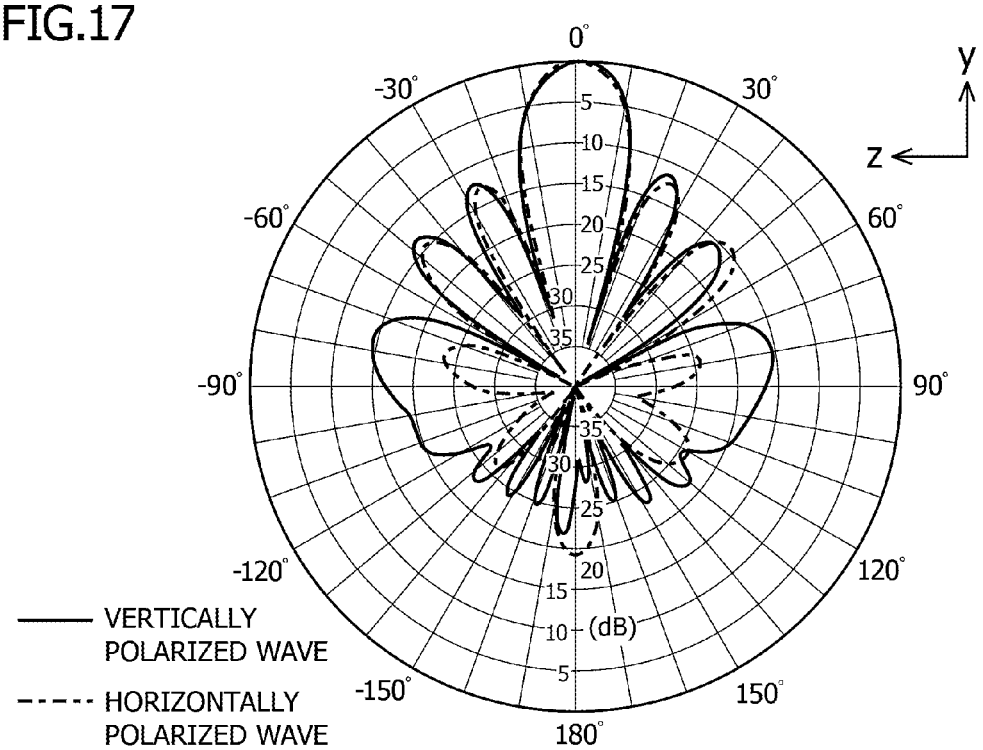
FIG. 17 is a graph which illustrates a radiation pattern of waves in the transmitting band on the yz plane of the transmitting-receiving-separated dual-polarization patch antenna having an array configuration.
Figure 18:
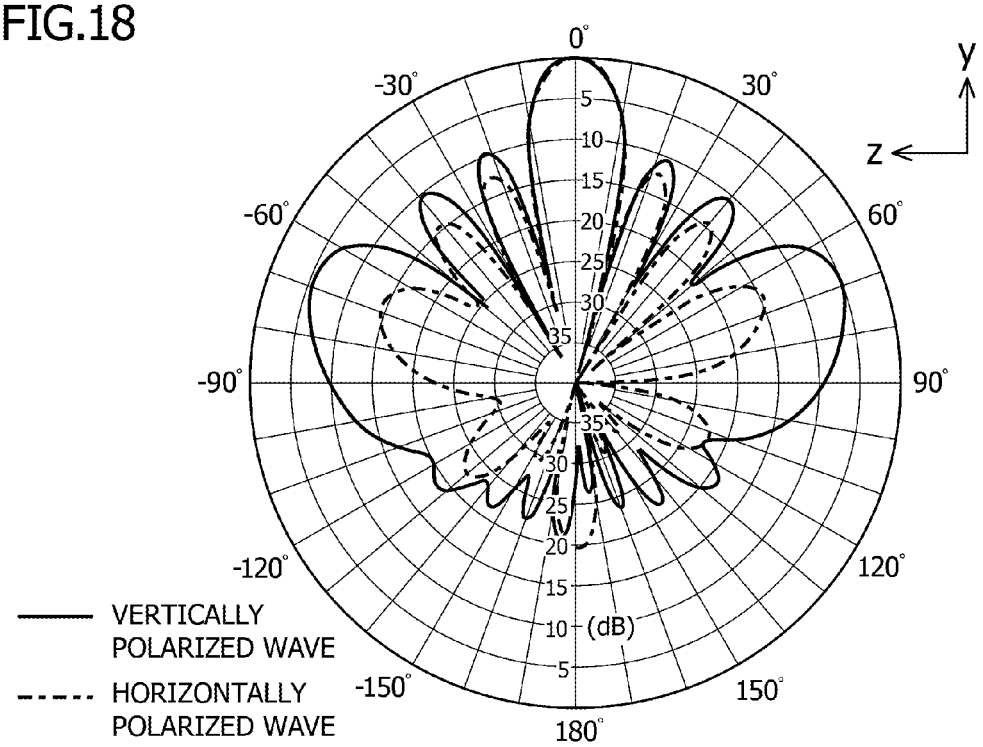
FIG. 18 is a graph which illustrates a radiation pattern of waves in the receiving band on the yz plane of the transmitting-receiving-separated dual-polarization patch antenna having an array configuration with altered element spacing.
Figure 19:
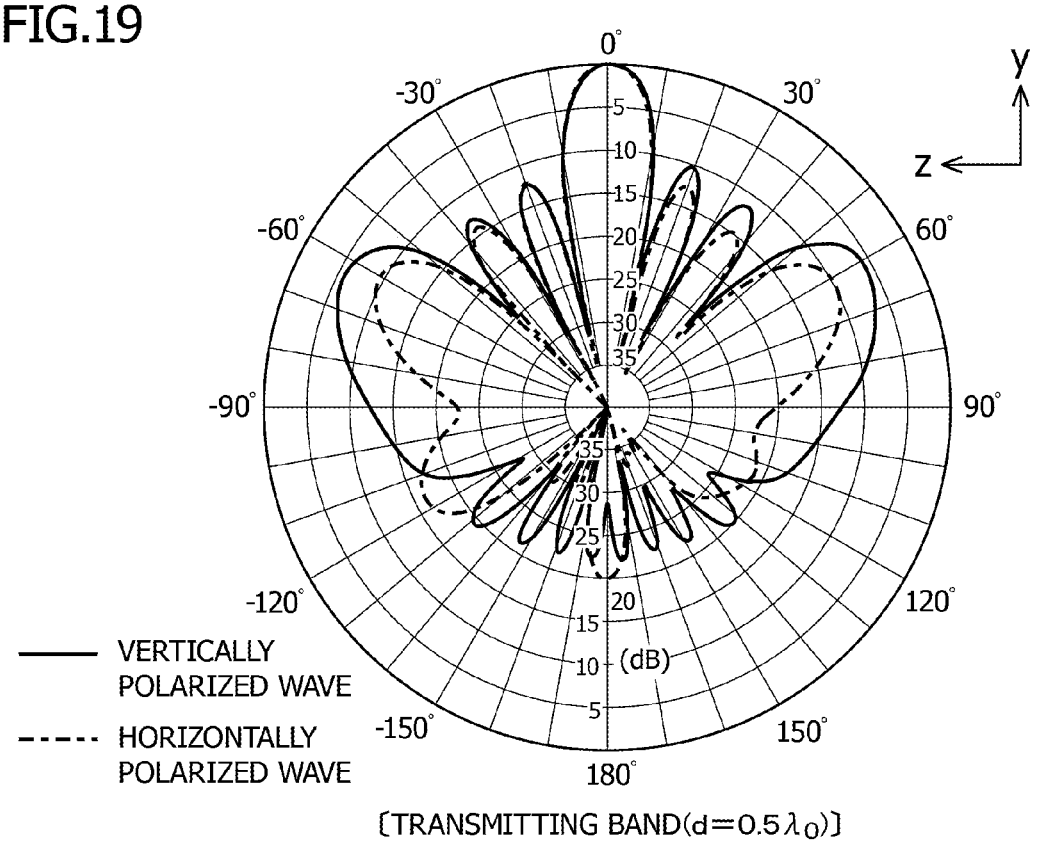
FIG. 19 is a graph which illustrates a radiation pattern of waves in the transmitting band on the yz plane of the transmitting-receiving-separated dual-polarization patch antenna having an array configuration with altered element spacing.
Figure 20:
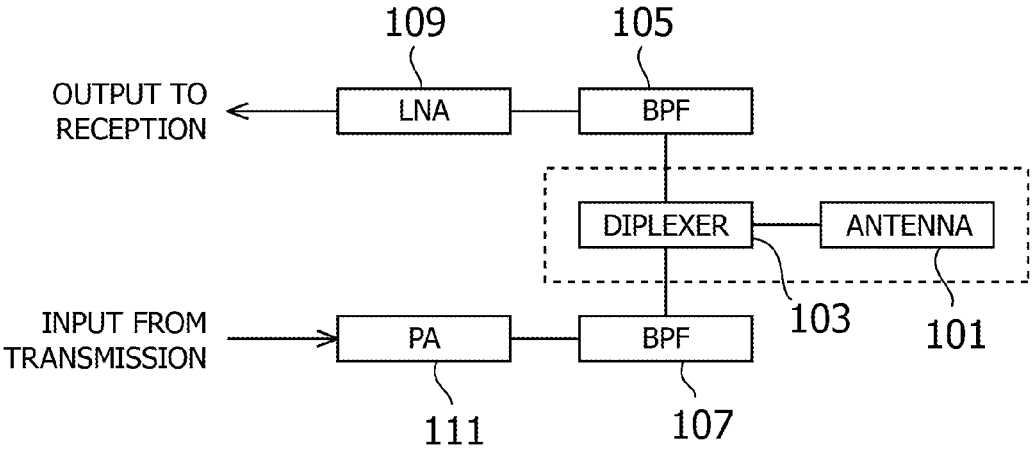
FIG. 20 is a block diagram which illustrates a configuration in which the transmitting and receiving front end circuit and the antenna are integrated together.
Figure 21:
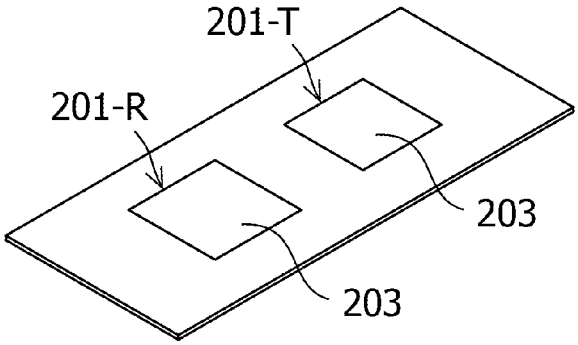
FIG. 21 is a perspective view which illustrates the conventional transmitting-receiving-separated dual-polarization patch antenna.
Figure 22:
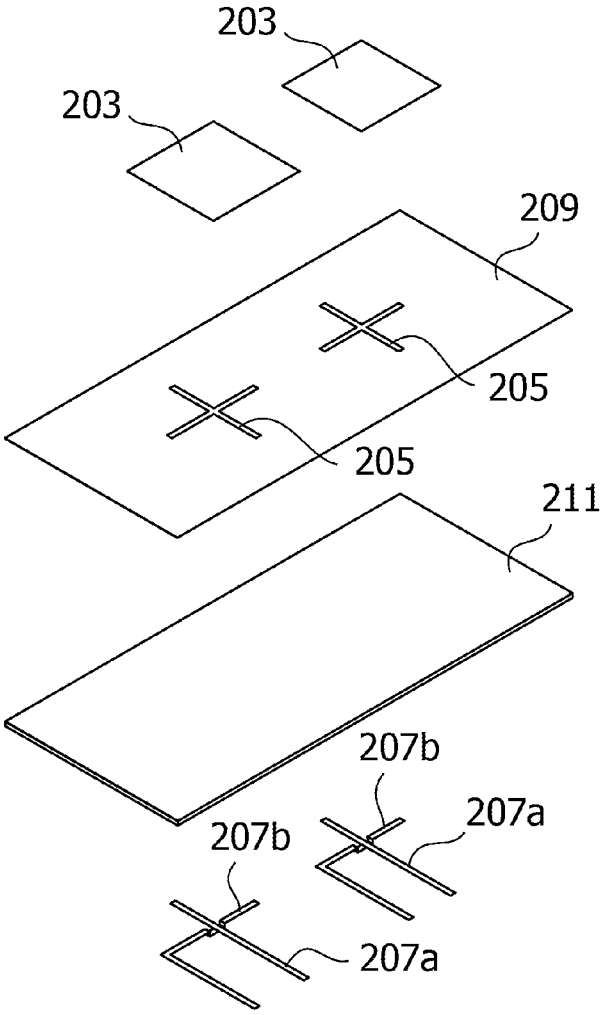
FIG. 22 is a an exploded view which illustrates the conventional transmitting-receiving-separated dual-polarization patch antenna.
Figure 23:
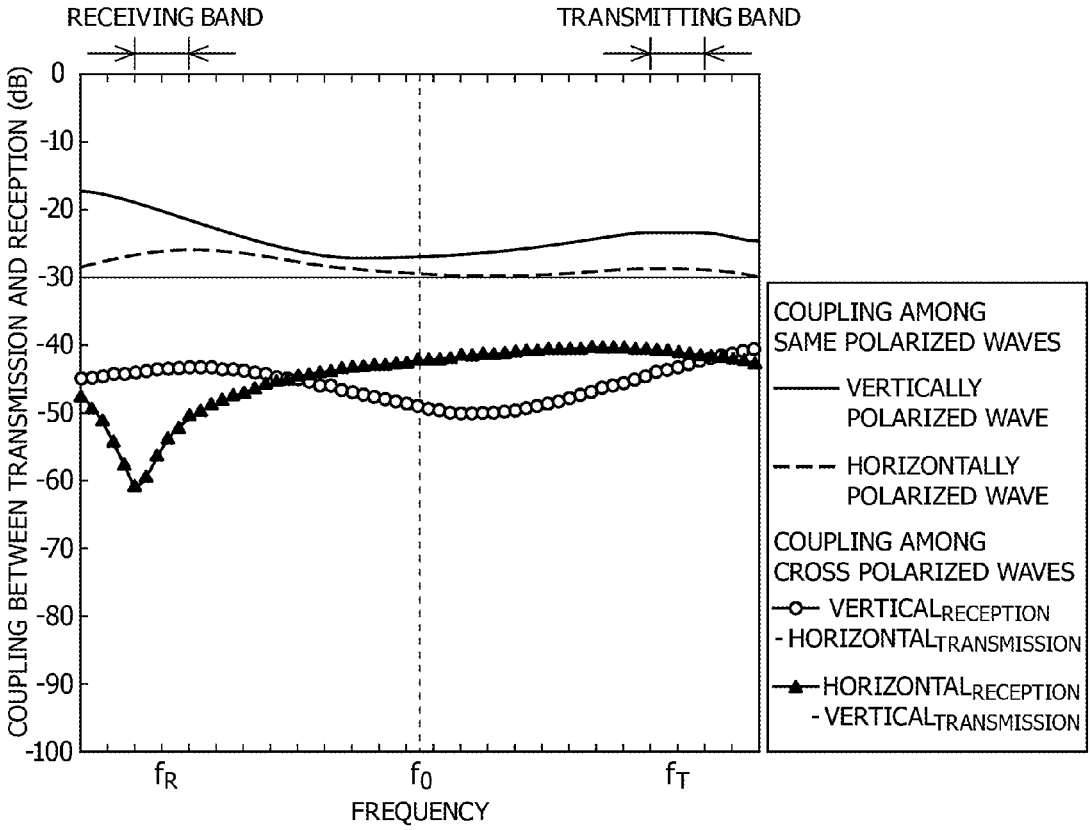
FIG. 23 is a graph which illustrates a characteristic of the conventional transmitting-receiving-separated dual-polarization patch antenna of coupling between transmission and reception.

FIGS. 16 and 17 illustrate the radiation pattern on the yz plane of the transmitting-receiving-separated dual-polarization patch antenna having an array configuration, in which multiple stages of the transmitting-receiving-separated dual-polarization patch antenna illustrated in FIG. 1 with the element spacing d of $0.4\lambda_0$ are arranged, in the receiving band and the transmitting band, respectively. FIGS. 18 and 19 illustrate the radiation pattern on the yz plane of Comparison Example in the receiving band and the transmitting band, respectively, in a case in which the element spacing d is $0.5\lambda_0$. Note that the radiation patterns are observed when the respective feeding points are excited at the same phase and by the same amplitude. In FIGS. 16 through 19, a solid line and a broken line denote the radiation pattern for vertically polarized waves and that for horizontally polarized waves, respectively. As is clear from comparisons between FIGS. 16 and 17 and FIGS. 18 and 19, if the element spacing d is $0.4\lambda_0$, then the maximum sidelobe level within the test range becomes about 13 dB, and thereby the grating lobe is more suppressed compared with the case where $d=0.5\lambda_0$. In the transmitting-receiving-separated dual-polarization patch antenna having an array configuration according to the present invention, the element spacing d is set at $0.5\lambda_0$ or narrower so that the coupling amount can be reduced while suppressing the grating lobe at the same time.

REFERENCE SIGNS LIST

1 Metal conductor
3-T Patch antenna for transmitting band
3-R Patch antenna for receiving band
5 Patch
7 Dielectric substrate
9 Upper-stage ground conductor
11 Dielectric substrate
13 Feed slot
15 Feed line
15*a* Feeding conductor for horizontally polarized wave
15*b* Feeding conductor for vertically polarized wave
15*c* Bridge conductor
17 Dielectric substrate
19 Lower-stage ground conductor
21 Slot
23, 25 Through hole
27 Feed slot
29 Metal plate

The invention claimed is:

1. A transmitting-receiving-separated dual-polarization antenna comprising:

a patch antenna for a transmitting band; and a patch antenna for a receiving band, the patch antenna for the transmitting band and the patch antenna for the receiving band having a predetermined spacing therebetween and being individually electrically fed, wherein each of the patch antenna for the transmitting band and the patch antenna for the receiving band comprises:

a top dielectric substrate, a middle dielectric substrate, and a bottom dielectric substrate, which are arranged in a stacked manner;

an upper-stage ground conductor constituted by a metal foil adhered to an upper surface of the middle dielectric substrate;

a lower-stage ground conductor constituted by a metal foil adhered to a lower surface of the bottom dielectric substrate;

a feeding conductor for a horizontally polarized wave and a feeding conductor for a vertically polarized wave, each constituted by a metal foil adhered to an upper surface of the bottom dielectric substrate;

a feed slot formed on the upper-stage ground conductor;

a patch constituted by a metal foil adhered to an upper surface of the upper dielectric substrate and electromagnetically coupled with the feeding conductor for a horizontally polarized wave and the feeding conductor for a vertically polarized wave via the feed slot; and an electromagnetic shielding member connected with the upper-stage ground conductor and the lower-stage ground conductor in a state in which the electromagnetic shielding member is located around the feeding conductor for a horizontally polarized wave and the feeding conductor for a vertically polarized wave, and wherein the top, middle, and bottom dielectric substrates of the patch antenna for the transmitting band, are spaced apart from the top, middle, and bottom dielectric substrates of the patch antenna for the receiving band.

2. The transmitting-receiving-separated dual-polarization antenna according to claim 1, wherein the electromagnetic shielding member is formed by multiple through holes, which are arranged around the feeding conductor for a horizontally polarized wave and the feeding conductor for a vertically polarized wave at predetermined spacing and extended from the upper-stage ground conductor to the lower-stage ground conductor.

3. The transmitting-receiving-separated dual-polarization antenna according to claim 1, wherein the electromagnetic shielding member is formed by a metal plate, which is arranged around the feeding conductor for a horizontally polarized wave and the feeding conductor for a vertically polarized wave and extended from the upper-stage ground conductor to the lower-stage ground conductor.

4. The transmitting-receiving-separated dual-polarization antenna according to claim 1, wherein the spacing for arranging the patch antenna for the transmitting band and the patch antenna for the receiving band is set at $0.5\lambda_0$ ($\lambda_0$ is a wavelength of a center frequency between a lower limit frequency for the receiving band and an upper limit frequency for the transmitting band) or smaller.

5. The transmitting-receiving-separated dual-polarization antenna according to claim 1, wherein the feed slot is square-shaped or cross-shaped.

6. A transmitting-receiving-separated dual-polarization antenna having an array configuration in which multiple stages of the transmitting-receiving-separated dual-polarization antenna according to claim 1 are arranged.

* * * * *